US011791552B2

(12) United States Patent
Min et al.

(10) Patent No.: US 11,791,552 B2
(45) Date of Patent: Oct. 17, 2023

(54) CENTER-FED ARRAY ANTENNA USING UNEQUAL POWER DIVIDER

(71) Applicant: INDUSTRY-ACADEMIC COOPERATION FOUNDATION, YONSEI UNIVERSITY, Seoul (KR)

(72) Inventors: Byung-Wook Min, Seoul (KR); Hae-Gwon Park, Seoul (KR); Sung Eun Kim, Seoul (KR)

(73) Assignee: INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 67 days.

(21) Appl. No.: 17/509,415

(22) Filed: Oct. 25, 2021

(65) Prior Publication Data

US 2022/0131274 A1 Apr. 28, 2022

(30) Foreign Application Priority Data

Oct. 26, 2020 (KR) ..... 10-2020-0138886

(51) Int. Cl.
*H01Q 21/00* (2006.01)
*H01Q 5/35* (2015.01)
(Continued)

(52) U.S. Cl.
CPC ..... *H01Q 21/0037* (2013.01); *H01Q 3/30* (2013.01); *H01Q 5/35* (2015.01); *H01Q 9/16* (2013.01); *H01Q 21/061* (2013.01)

(58) Field of Classification Search
CPC ..... H01Q 21/0037; H01Q 5/35; H01Q 9/16; H01Q 5/16; H01Q 13/206; H01Q 3/30–42
(Continued)

(56) References Cited

U.S. PATENT DOCUMENTS 4,123,759 A * 10/1978 Hines ..... H01Q 3/242 343/832
5,079,527 A * 1/1992 Goldfarb ..... H01P 5/16 333/127
(Continued)

FOREIGN PATENT DOCUMENTS

KR 10-2015-0018697 A 2/2015
KR 10-2015-0086604 A 7/2015
(Continued)

*Primary Examiner* — Ab Salam Alkassim, Jr.
*Assistant Examiner* — Brandon Sean Woods

(57) ABSTRACT

A center-fed array antenna comprises: a central radiation element located in the center among the odd number of N radiation elements; a first radiation part including n (=(N−1)/2) first radiation elements positioned on one side of the central radiation element and n first phase shifters corresponding to each of the n first radiation elements; a second radiation part including n second radiation elements positioned on the other side of the central radiation element and n second phase shifters corresponding to each of the n second radiation elements; and a 3-way power divider distributes the received feed signal in an asymmetric ratio in proportion to the ratio of the number of radiation elements included in the central radiation element and the first and second radiation parts, and outputs the obtained first to third distribution feed signals to the corresponding central radiation element and the first and second radiation parts, respectively.

16 Claims, 9 Drawing Sheets

(51) Int. Cl.
*H01Q 9/16* (2006.01)
*H01Q 3/30* (2006.01)
*H01Q 21/06* (2006.01)

(58) Field of Classification Search
USPC ..... 343/702
See application file for complete search history.

(56) References Cited

U.S. PATENT DOCUMENTS 5,940,030 A * 8/1999 Hampel ..... H01Q 21/0006 342/368
2005/0093737 A1* 5/2005 Schoebel ..... H01Q 3/36 342/72

FOREIGN PATENT DOCUMENTS

KR 10-1726412 B1 4/2017
KR 10-2017-0051046 A 5/2017

* cited by examiner

CENTER-FED ARRAY ANTENNA USING UNEQUAL POWER DIVIDER

CROSS-REFERENCE TO RELATED APPLICATIONS

This application claims priority under 35 U.S.C. § 119(a) to Korean Patent Application No. 10-2020-0138886, filed on Oct. 26, 2020, in the Korean Intellectual Property Office, the disclosure of which is incorporated herein in its entirety by reference.

BACKGROUND

1. Technical Field

The present disclosure relates to an array antenna, more particularly to a center-fed array antenna using an unequal power divider.

2. Description of the Related Art

Since the array antenna (also called as a phased array antenna) in which a plurality of radiation elements are arranged can control the direction of the beam by adjusting the phase of the feed signal applied to the plurality of radiation elements and beam forming, it is used in various fields.

FIG. 1 shows an example of an array antenna having a series-fed structure.

As shown in FIG. 1, in the array antenna, a series-fed structure is usually used, in which a feed signal is generally applied to one side of an element array in which a plurality of radiation elements ($a_1$~$a_n$) are arranged and the feed signal is sequentially transmitted in the other direction. Here, the feed signal transmitted to the adjacent radiation element may be phase shifted by the same magnitude (Δø) by a plurality of phase shifters ($p_1$~$p_n$) and sequentially transmitted.

The array antenna of such a series-fed structure transmits a feed signal with adjusting the phase by the same magnitude, so it has a simple structure, a very narrow bandwidth, and low loss. Therefore, it is mainly used for beam-forming rather than electrical beam-steering.

However, the series-fed structure has a problem in that a beam-squint occurs in which the direction of the beam deviates from a required direction depending on the frequency. Moreover, due to the loss of the phase shifter, a tapering effect occurs in which the power of one side to which the feed signal is applied becomes greater than that of the other side, that is, the power is not equally distributed, and this causes a problem of increasing the sidelobe level.

Accordingly, a parallel-fed structure in which the applied feed signal is hierarchically and repeatedly distributed using a plurality of 2-way dividers and supplied to a plurality of radiation elements has been proposed. However, in the case of a parallel-fed structure, a plurality of 2-way dividers must be provided, and a high-performance phase shifter is required because the feed signals supplied to a plurality of radiation elements must be individually adjusted to have different phases, respectively. Accordingly, there is a limitation in that the manufacturing cost increases and the phase control is not easy.

In order to solve the problems of the series-fed structure and the parallel-fed structure, a center-fed structure in which feed signals are fed in both directions from the center of the element array is also used.

FIG. 2 shows an example of an array antenna having a center-fed structure.

As shown in FIG. 2, in the array antenna of the center-fed structure, a feed signal is applied to a 2-way divider (div) located at the center of a plurality of radiation elements (($a_n$~$a_{1n}$), ($a_{21}$~$a_{2n}$)), feed signals distributed from the 2-way divider are symmetrically supplied to both sides, and since the beam shifts symmetrically in both directions with respect to the center, it is possible to suppress the occurrence of the beam-squint phenomenon of the main beam. In addition, for the remaining radiation elements (($a_{12}$~$a_{1n}$), ($a_{22}$~$a_{2n}$)) except for the two radiation elements ($a_n$, $a_{21}$) located adjacent to the center, it is the same as the series-fed structure in each direction, so the phase shifters (($p_{12}$~$p_{1n}$), ($p_{22}$~$p_{2n}$)) may adjust the phase of the feed signal by the same magnitude (−Δø, Δø) and transmit it sequentially.

However, in an array antenna having a conventional center-fed structure, since a 2-way divider (div) is disposed at the center, an even number of radiation elements (($a_{11}$~$a_{1n}$), ($a_{21}$~$a_{2n}$)) must be provided in order to maintain a symmetrical structure. Accordingly, the two phase shifters ($p_{11}$, $p_{21}$) that transmit the feed signal to the two radiation elements ($a_n$, $a_{21}$) located adjacent to the center have to adjust the phase by a different magnitude (−1/2Δø, 1/2Δø) from the other phase shifters (($p_{12}$~pin), ($p_{22}$~$p_{2n}$)). That is, the two phase shifters ($p_n$, $p_{21}$) between the two radiation elements ($a_n$, $a_{21}$) should be able to adjust the phase by a different magnitude from the other phase shifters (($p_{12}$~pin), ($p_{22}$~$p_{2n}$)). Accordingly, the circuit structure must be configured to be different from the structure between the other radiation elements.

Therefore, the array antenna of the center-fed structure also causes a problem of increasing the manufacturing cost similarly to the array antenna of the parallel-fed structure.

SUMMARY

An object of the present disclosure is to provide a center-fed array antenna capable of simplifying the configuration for adjusting the phase of a feed signal transmitted between a plurality of radiation elements using an unequal power distributor/distribution and phase shifting/modulation.

Another object of the present disclosure is to provide a center-fed array antenna that can be manufactured at low cost and can easily adjust the phase of a feed signal.

A center-fed array antenna according to an embodiment of the disclosure, conceived to achieve the objectives above, comprises: a central radiation element located in the center among the odd number of N radiation elements; a first radiation part including n (=(N−1)/2) first radiation elements positioned on one side with respect to the central radiation element and n first phase shifters corresponding to each of the n first radiation elements; a second radiation part including n second radiation elements positioned on the other side with respect to the central radiation element and n second phase shifters corresponding to each of the n second radiation elements; and a 3-way power divider which receives a feed signal, distributes the received feed signal in an asymmetric ratio in proportion to the ratio of the number of radiation elements included in the central radiation element and the first and second radiation parts, and outputs the obtained first to third distribution feed signals to the corresponding central radiation element and the first and second radiation parts, respectively.

The 3-way power divider may include: a 2-way divider that receives the feed signal, divides the power of the applied feed signal into two equally, and outputs two divided feed signals (split feed signals); first and second couplers each receiving one of the two split feed signals, coupling to the applied split feed signal, and extracting a coupling signal having 1/N power of the power of the split feed signal, obtaining the remaining split feed signals from which the coupling signal is extracted, as first and third distribution feed signals among the first to third distribution feed signals, and then outputting to a corresponding radiation part among the first and second radiation parts; and a combiner for receiving and combining the coupling signal extracted from each of the first and second couplers to obtain a second distribution feed signal and outputting it to the central radiation element.

The 2-way divider may be implemented as a Wilkinson power divider, and the combiner may be implemented as a Wilkinson combiner.

The n first phase shifters may be connected in series from one end of the 3-way power divider through which the first distribution feed signal is output.

The n first phase shifters may receive the same first bias voltage and adjust the phase by a pre-designated same phase.

In the n first radiation elements, n−1 first radiation elements may be connected in parallel between the n first phase shifters, and the n-th first radiation element may be connected in series to the n-th first phase shifter among the n first phase shifters.

The n second phase shifters may be connected in series from the other end of the 3-way power divider through which the third distribution feed signal is output.

The n second phase shifters may receive the same second bias voltage and adjust the phase by the same magnitude having opposite signs to those of the n first phase shifters.

In the n second radiation elements, n−1 second radiation elements may be connected in parallel between the n second phase shifters, and the n-th second radiation element may be connected in series to the n-th second phase shifter among the n second phase shifters.

In the center-fed array antenna, a beam direction may be adjusted according to the applied first and second bias voltages.

The center-fed array antenna may further include a plurality of impedance conversion means for performing impedance matching by using the impedance of each of the n first phase shifters and the n second phase shifters as a reference impedance.

The plurality of impedance conversion means may include: an input impedance converting means connected to an input terminal to which the feed signal is applied in the 3-way power divider; a central impedance converting means connected between the 3-way power divider and the central radiation element; n first series impedance conversion means having one end connected to the other end of each of the n first phase shifters connected in series; n first parallel impedance converting means connected between the other end of the n series impedance converting means and a corresponding radiation element among the n first radiation elements; n second series impedance conversion means having one end connected to the other end of each of the n second phase shifters connected in series; and n second parallel impedance converting means connected between the other end of the n series impedance converting means and a corresponding radiation element among the n second radiation elements.

The 3-way power divider may further include a DC braking element disposed between the first and second couplers and the first and second radiation parts, respectively, to filter a DC component.

The 3-way power divider may further include a DC braking element disposed between the 2-way divider and the first and second couplers, respectively, to filter a DC component.

Therefore, the center-fed array antenna according to an embodiment of the disclosure makes it possible to distribute power equally to the radiation element located in the center of the odd number radiation elements and the radiating elements located on both sides to supply a feed signal, so the phase spacing adjusted between the plurality of radiation elements becomes uniform, and since it makes the power supplied to each radiation element equal, not only is it easy to adjust the phase, but also it can easily steer the beam and can be manufactured at low cost.

DETAILED DESCRIPTION

Figure 1:
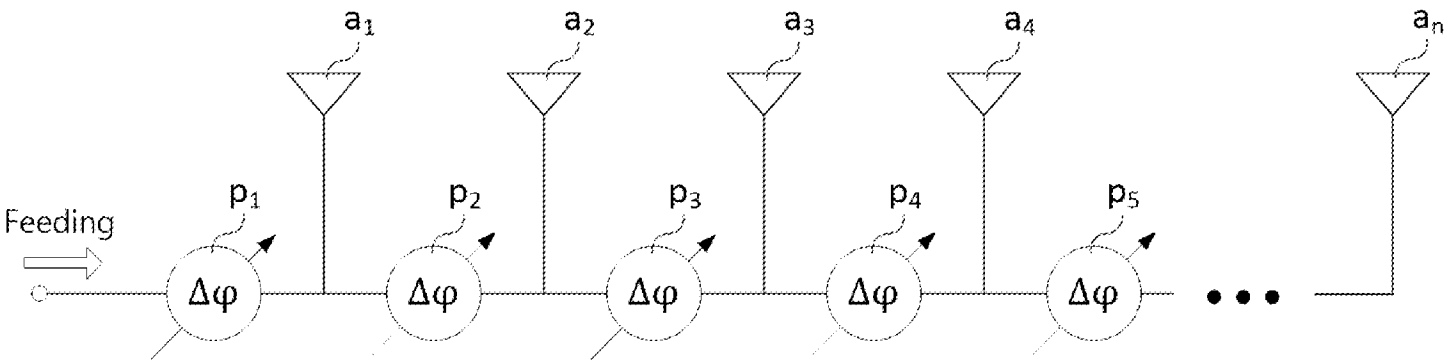
FIG. 1 shows an example of an array antenna having a series-fed structure.

In order to fully understand the present disclosure, operational advantages of the present disclosure, and objects achieved by implementing the present disclosure, reference should be made to the accompanying drawings illustrating preferred embodiments of the present disclosure and to the contents described in the accompanying drawings.

Hereinafter, the present disclosure will be described in detail by describing preferred embodiments of the present disclosure with reference to accompanying drawings. However, the disclosure can be implemented in various different forms and is not limited to the embodiments described herein. For a clearer understanding of the disclosure, parts that are not of great relevance to the disclosure have been omitted from the drawings, and like reference numerals in the drawings are used to represent like elements throughout the specification.

Throughout the specification, reference to a part "including" or "comprising" an element does not preclude the existence of one or more other elements and can mean other elements are further included, unless there is specific mention to the contrary. Also, terms such as "unit", "device", "module", "block", etc., refer to units for processing at least one function or operation, where such units can be implemented as hardware, software, or a combination of hardware and software.

Figure 3:
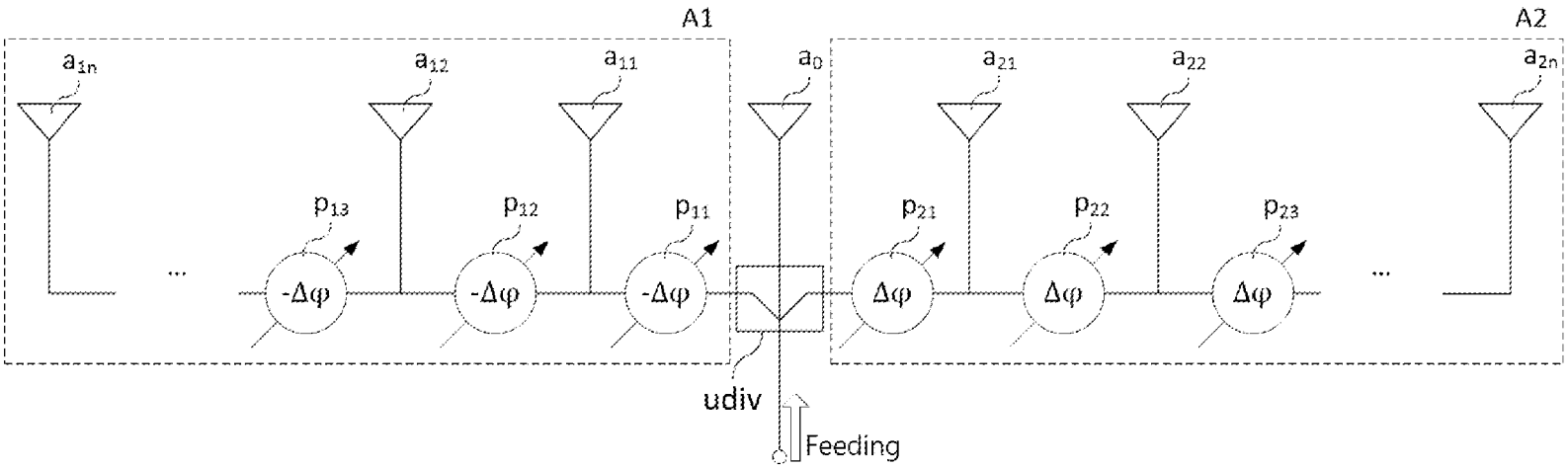
FIG. 3 shows an example of a center-fed array antenna according to an embodiment of the present disclosure.
Figure 4:
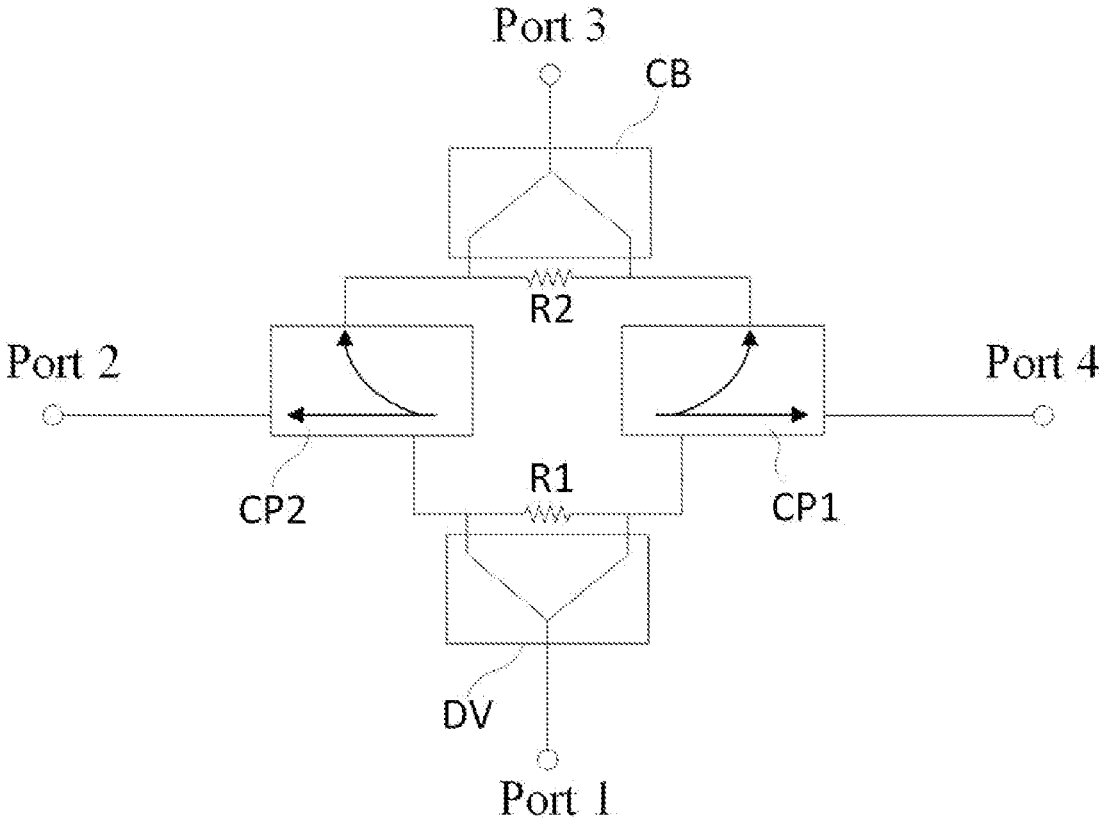
FIG. 4 shows an example of the structure of the unequal power divider of FIG. 3.

FIG. 3 shows an example of a center-fed array antenna according to an embodiment of the present disclosure, and FIG. 4 shows an example of the structure of the unequal power divider of FIG. 3.

Referring to FIG. 3, the center-fed array antenna according to the present embodiment includes N (=2n+1) radiation elements (($a_1$~$a_{1n}$), $a_0$, ($a_{21}$~$a_{2n}$)) in which n radiation elements (($a_1$~$a_{1n}$), ($a_{21}$~$a_{2n}$)) are disposed symmetrically on both sides with respect to the central radiation element ($a_0$) disposed in the center. That is, in the present embodiment, the center-fed array antenna includes an odd number of radiation elements, unlike the center-fed array antenna of FIG. 2.

Here, for convenience of description, one side of the central radiation element ($a_0$) is referred to as a first radiation part (A1) and the other side is called a second radiation part (A2). That is, each of the first and second radiation parts (A1, A2) includes n radiation elements (($a_{11}$~$a_{1n}$), ($a_{21}$~$a_{2n}$)).

In addition, the center-fed array antenna of the present embodiment includes an unequal power divider (udiv) for receiving a feed signal and distributing the feed signal to a plurality of radiation elements. In the present embodiment, the unequal power divider (udiv) is positioned at the center of the N radiation elements, as shown in FIG. 3. The unequal power divider (udiv) positioned at the center of the N radiation elements distributes the applied feed signal according to a pre-designated ratio to obtain three first to third distribution feed signals, and transmits the obtained first to third distribution feed signals to the central radiation element ($a_0$), the first radiation part (A1), and the second radiation part (A2), respectively. The second distribution feed signal is applied to the central radiation element ($a_0$), and the first and third distribution feed signals are applied to the first and second radiation parts (A1, A2).

Here, the unequal power divider (udiv) distributes the power of the feed signal in proportion to the number of the central radiation element ($a_0$) and the radiation elements (n=(N−1)/2) of each of the first radiation part (A1) and the second radiation part (A2). That is, the unequal power divider (udiv) is a 3-way power divider that distributes the power of the feed signal into first to third distribution feed signals asymmetrically according to the ratio of n:1:n(=(N−1)/2:1:(N−1)/2) according to the number of radiation elements (n=(N−1)/2) included in the first radiation part (A1) and the second radiation part (A2).

As an example, if the first radiation part (A1) and the second radiation part (A2) each include five (n=5) radiation elements, the unequal power divider (udiv) asymmetrically divides the power of the feed signal by 5:1:5, transmits the first and third distribution feed signals each having a power of 5 to the first radiation part (A1) and the second radiation part (A2), and transmits the second distribution feed signal having a power of 1 to the central radiation element ($a_0$).

That is, the unequal power divider (udiv) distributes power equally according to the number of radiation elements and transmits the distribution feed signals.

The 3-way power divider (udiv) may be implemented in various circuit structures, but in the present embodiment, a 3-way unequal power divider (udiv) having the structure of FIG. 4 is used as an example.

Referring to FIG. 4, the 3-way unequal power divider (udiv) according to the present embodiment may be implemented as a 4-port (Port1~Port4) device including one 2-way divider (DV), two couplers (CP1, CP2), and one combiner (CB).

First, the 2-way divider (DV) equally divides the power of the feed signal applied through the first port (Port1) into two and transmits the two divided feed signals to the two couplers (CP1, CP2), respectively. Here, the 2-way divider may be implemented as, for example, a Wilkinson power divider. The Wilkinson power divider connects the two output terminals of the 2-way divider (DV) through the resistor (R1), as shown in FIG. 4, to perform impedance matching and to make the two split feed signals have the same phase. Wilkinson power divider is the most commonly used divider, and has a simple configuration, so there is an advantage in that not only is it possible to distribute power with the same phase at low cost, but it is also possible to secure sufficient isolation between ports by −20 dB or more.

The two couplers (CP1, CP2) each receive a corresponding split feed signal among the two split feed signals applied from the 2-way divider (DV), and extract a coupling signal by coupling at a pre-designated power ratio from the received split feed signal. Here, each of the two couplers (CP1, CP2) extracts the coupling signal at a power ratio of 1/N from the split feed signal according to the ratio of the number of central radiation elements ($a_0$) to the total number of radiation elements (N=2n+1). Then, each of the two couplers (CP1, CP2) acquires the remaining split feed signal that has a power ratio of (N−1)/N compared to the split feed signal by extracting the coupling signal from the split feed signal by the couplers (CP1, CP2), as the first and third distribution feed signals.

At this time, the split feed signal is a signal in which the power of the feed signal is already divided by half by a 2-way divider (DV), so the first and third distribution feed signals are signals having a power of(N−1)/2N magnitude in comparison to the feed signal applied to the first port (Port1), and the coupling signal is a signal having a power of 1/2N magnitude compared to the feed signal.

Each of the two couplers (CP1, CP2) transmits the extracted coupling signal to the combiner (CB), and transmits the first and third distribution feed signals to the corresponding radiation group of the first or second radiation part (A1, A2) through the second port (Port2) or the fourth port (Port4).

The combiner (CB) combines the coupling signals applied from each of the two couplers (CP1, CP2) to obtain a second distribution feed signal, and transmits the obtained second distribution feed signal to the central radiation element ($a_0$) through the third port (Port3). Here, the combined feed signal is a combination of coupling signals having a power of 1/2N magnitude in each of the two couplers (CP1, CP2), and has a power of 1/N magnitude.

Here, the combiner (CB) may be implemented as, for example, a Wilkinson power combiner. Similar to the Wilkinson power divider, the Wilkinson power combiner performs impedance matching by connecting two input terminals of the 2-way combiner (CB) with a resistor (R2), as shown in FIG. 4, and makes the two applied in-phase signals combined. Wilkinson power combiner can also ensure sufficient port-to-port isolation of −20 dB or more. Therefore, the 3-way unequal power divider (udiv) can secure the port-to-port isolation of −20 dB or more for all ports (Port1 Port4).

As a result, the 3-way unequal power divider (udiv) of FIG. 4 divides the power of the feed signal applied through the first port (Port1), outputs the first and third distribution feed signals each having a power of (N−1)/2N magnitude to the second port (Port2) and the fourth port (Port4), respectively, and, outputs the second distribution signal having a power of 1/N magnitude to the third port (Port3). That is, it outputs the first to third distribution feed signals through corresponding ports among the second to fourth ports (Port2~Port4), by dividing the power of the feed signal in an asymmetric ratio of (N−1)/2:1:(N−1)/2.

One central radiation element ($a_0$) located in the center among the N radiation elements is connected to the third port (Port3) of the 3-way unequal power divider (udiv), receives and radiates a second distribution signal having a power of 1/N magnitude of the feed signal.

To the first radiation part (A1) and the second radiation part (A2), the first or third distribution feed signal having a power of (N−1)/2N magnitude is applied through the second port (Port2) and the fourth port (Port4) of the 3-way unequal power divider (udiv), respectively. Since the first radiation part (A1) and the second radiation part (A2) each include n (=(N−1)/2) radiation elements (($a_1$~$a_{1n}$), ($a_{21}$~$a_{2n}$)), the 3-way unequal power divider (udiv) can be viewed as distributing the power of the feed signal in proportion to the number of radiation elements and supplying.

Meanwhile, to each of the n radiation elements (($a_1$~$a_{1n}$), ($a_{21}$~$a_{2n}$)) of the first radiation part (A1) and the second radiation part (A2), a signal is applied into which the first or third distribution signal is re-distributed according to the serial distribution structure.

Accordingly, the first radiation part (A1) and the second radiation part (A2) include, together with n radiation elements (($a_{11}$~$a_{1n}$), ($a_{21}$~$a_{2n}$)), n phase shifters (($p_{11}$~$p_{1n}$), ($p_{21}$~$p_{2n}$)) corresponding to the number of radiation elements (($a_{11}$~$a_{1n}$), ($a_{21}$ $a_{2n}$)). In each of the first radiation part (A1) and the second radiation part (A2), the phase shifters (($p_{11}$~$p_{1n}$), ($p_{21}$~$p_{2n}$)) are connected in series, and each of the n radiation elements (($a_{11}$~$a_{1n}$), ($a_{21}$~$a_{2n}$)) is connected in parallel between the n phase shifters (($p_{11}$~$p_{1n}$), ($p_{21}$~$p_{2n}$)) connected in series. Accordingly, each of the n radiation elements (($a_{11}$~$a_{1n}$), ($a_{21}$~$a_{2n}$)) receives the distribution feed signal that is phase-adjusted and re-distributed through a corresponding number of phase shifters (($p_{11}$~$p_{1n}$), ($p_{21}$~$p_{2n}$)) in the first or third distribution feed signal applied from the 3-way unequal power divider (udiv), and radiates it.

Figure 2:
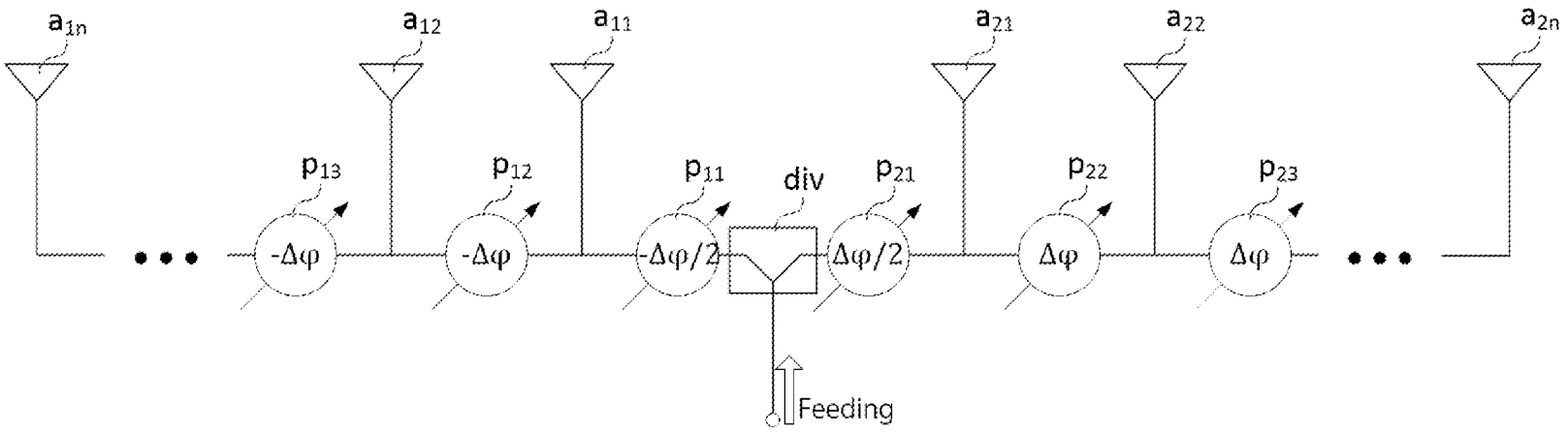
FIG. 2 shows an example of an array antenna having a center-fed structure.

In the array antenna having a conventional center-fed structure shown in FIG. 2, the central radiation element ($a_0$) does not exist and an even number of radiation elements are provided, so in the two radiation elements ($a_n$, $a_{21}$) adjacent to the center, receiving the feed signal transmitted from the 2-way divider (div) first, the corresponding two phase shifters ($p_n$, $p_{21}$) had to adjust the phase by a different magnitude than the other phase shifters such that the phase difference between the radiation elements becomes equal to the phase difference between the other radiation elements (($a_{12}$~$a_{1n}$), ($a_{22}$~$a_{2n}$)). In FIG. 2, the two phase shifters ($p_n$, $p_{21}$) adjusted the phase by a magnitude of (−1/2Δø, 1/2Δø), while the remaining phase shifters (($p_{12}$~$p_{1n}$), ($p_{22}$~$p_{2n}$)) adjusted the phase by a magnitude of (−Δø, Δø). That is, it had to adjust not only the sign of the phase to be adjusted but also the magnitude to be different. Due to this, not only the configuration of the phase shifter was difficult, but also the phase shift was not easy.

In contrast, in the array antenna of the center-fed structure according to the present embodiment shown in FIG. 3, a 3-way unequal power divider (udiv) is applied so that the central radiation element ($a_0$) is present. Therefore, the phase difference (−Δø, Δø) should be equally reflected between the central radiation element ($a_0$) and the adjacent radiation element ($a_{11}$, $a_{21}$) as between other radiation elements (($a_{12}$~$a_{1n}$), ($a_{22}$~$a_{2n}$)). Accordingly, the phase shifters (($p_{11}$ $p_{1n}$), ($p_{21}$~$p_{2n}$)) of the first and second radiation parts (A1, A2) may be configured to adjust the phase of the applied distribution feed signal by a uniform magnitude, only different in sign, and transmit it. Therefore, the configuration of the phase shifter is convenient, and the phase shift is easy. In particular, since the bias voltage for adjusting the phase by a magnitude of (−1/2Δø, 1/2Δø) is not required, the manufacturing cost can be greatly reduced in actual implementation. That is, the beam can be controlled by applying only two bias voltages for adjusting the phase equally with the phase shifters (($p_{11}$~$p_{1n}$), ($p_{21}$~$p_{2n}$)).

Figure 5:
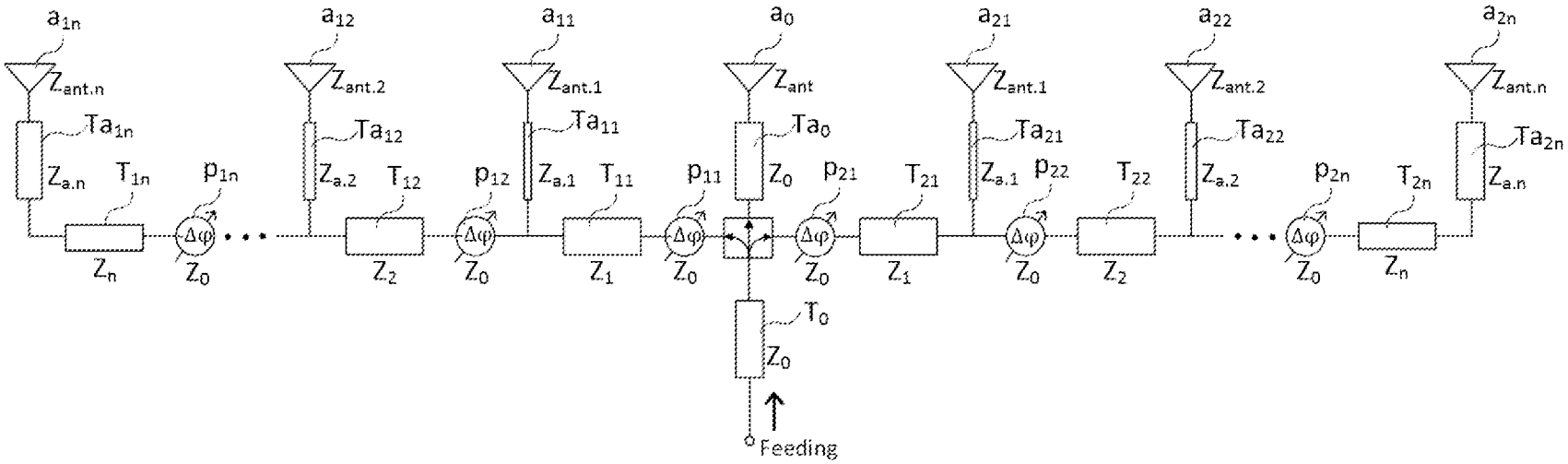
FIG. 5 shows an example of a center-fed array antenna according to another embodiment of the present disclosure.

FIG. 5 shows another example of a center-fed array antenna according to another embodiment of the present disclosure.

In the array antenna of FIG. 3, the n radiation elements (($a_{11}$~$a_{1n}$), ($a_{21}$~$a_{2n}$)) of each of the first and second radiation parts (A1, A2) are connected in parallel to each other, so when the first or third distribution feed signal having a power of (N−1)/2N magnitude is applied, the power should be distributed equally to n radiation elements (($a_{11}$~$a_{1n}$), ($a_{21}$~$a_{2n}$)) and applied in a magnitude of 1/N. That is, in the array antenna, the applied feed signal should be distributed and applied with equal power to N (=2n+1) radiation elements (($a_1$~$a_{1n}$), $a_0$, ($a_{21}$~$a_{2n}$)).

However, in reality it is not easy to fabricate a structure for distributing equal power to each radiation element in a series-fed structure in which the same phase shifters exist as in the first and second radiation parts (A1, A2). The power applied to each radiation element (($a_1$~$a_{1n}$), $a_0$, ($a_{21}$~$a_{2n}$)) of the first and second radiation parts (A1, A2) is decided by the ratio of the impedance looking at the radiation element side and the impedance looking at the phase shifter side at the branch where each radiation element (($a_{11}$~$a_{1n}$), $a_0$, ($a_{21}$~$a_{2n}$)) is branched from the first radiation elements ($a_n$, $a_{21}$) disposed adjacent to the 3-way unequal power divider (udiv) to the n-th radiation elements ($a_{1n}$, $a_{2n}$) in each of the first and second radiation parts (A1, A2).

Therefore, in order to evenly distribute power to N(=2n+1) radiation elements (($a_{11}$~$a_{1n}$), $a_0$, ($a_{21}$~$a_{2n}$)), the impedance on the path through which the distribution feed signal is transmitted to each of the N radiation elements (($a_{11}$~$a_{1n}$), $a_0$, ($a_{21}$~$a_{2n}$)) must be matched.

In FIG. 5, it further includes a plurality of impedance conversion means for matching the impedance on the path through which the distribution feed signal is transmitted to each of the N radiation elements (($a_{11}$~$a_{1n}$), $a_0$, ($a_{21}$~$a_{2n}$)).

Referring to FIG. 5, the array antenna uses the impedance of each of the plurality of phase shifters (($p_{11}$~$p_{1n}$), ($p_{21}$~$p_{2n}$)) as a reference impedance ($Z_0$) to match the impedance.

Accordingly, the array antenna may include an input impedance conversion means ($T_0$) connected to an input terminal via which a feed signal is applied to a 3-way unequal power divider (udiv), i.e. the first port (Port1) of the 3-way unequal power divider (udiv), and a central impedance conversion means (Tao) connected between the 3-way unequal power divider (udiv) and the central radiation element ($a_0$). Here, both the input impedance conversion means ($T_0$) and the central impedance conversion means (Tao) have the reference impedance ($Z_0$).

In addition, the array antenna may include a plurality of series impedance conversion means (($T_{11}$~$T_{1n}$), ($T_{21}$~$T_{2n}$)) each connected between a plurality of phase shifters (($p_{11}$ $p_{1n}$), ($p_{21}$~$p_{2n}$)) connected in series from a 3-way unequal power divider (udiv) in each of the first and second radiation parts (A1, A2) and a plurality of parallel impedance conversion means (($Ta_{11}$~$Ta_{1n}$), ($Ta_{21}$~$Ta_2$n)) each connected between the other end of plurality of series impedance conversion means (($T_{11}$~$T_{1n}$), ($T_{21}$~$T_{2n}$)) connected to the corresponding phase shifter at one end and the corresponding radiation element among the plurality of radiation elements (($a_{11}$~$a_{1n}$), ($a_{21}$~$a_{2n}$)).

Here, as shown in FIG. 5, the impedance of the central radiation element ($a_0$) among the N radiation elements (($a_{11}$~$a_{1n}$), $a_0$, ($a_{21}$~$a_{2n}$)) is referred to as $Z_{ant}$, and the impedance of each of the n radiation elements of the symmetrically configured first and second radiation parts (A1, A2) is referred to as ($Z_{ant.1}$~$Z_{ant.n}$). In addition, the impedance of the plurality of series impedance conversion means (($T_{11}$ $T_{1n}$), ($T_{21}$~$T_{2n}$)) is referred to as ($Z_1$~$Z_n$), and the impedance of the plurality of parallel impedance conversion means (($Ta_{11}$~$Ta_{1n}$), ($Ta_{21}$~$Ta_{2n}$)) is referred to as ($Z_{a.1}$~$Z_{a.n}$).

First, looking at the process in which the first and third distribution feed signals are transmitted from the first and second radiation parts (A1, A2) to the first radiation elements (all, $a_{21}$), the impedance ($Z_{a.1}$) of the first parallel impedance conversion means ($Ta_{11}$, $Ta_{21}$) should be $Z_{a.1}=Z_0\circ(n-1)$, such that power is distributed in a ratio of 1:n−1 with the impedance of phase shifters ($p_{12}$, $p_{22}$) connected to the subsequent terminal.

If, in order to convert the impedance ($Z_{a.i}$) of the first parallel impedance conversion means ($Ta_{11}$, $Ta_{21}$) to the impedance ($Z_{ant}$) of the central radiating element ($a_0$), it is defined as a 90 degree conversion impedance, it is calculated as $Z_{a.1}=\sqrt{Z_0\cdot(n-1)\cdot Z_{ant}}$.

Meanwhile, the impedance ($Z_1$) of the first series impedance conversion means ($Ta_{11}$, $Ta_{21}$) can be calculated as $$Z1 = Z_0 \cdot \sqrt{\frac{n-1}{n}}$$

such that it can perform a 90 degree impedance conversion (Quarter-wave Impedance Transform) in order to convert the impedance ($Z_0$) of the previously arranged phase shifters ($p_{11}$, $p_{21}$) into $Z_0$ II $Z_0 \| Z_0\circ(n-1)$.

Similarly, the impedance ($Z_{a.2}$) of the second parallel impedance conversion means ($Ta_{12}$, $Ta_{22}$) and the impedance ($Z_2$) of the second series impedance conversion means ($T_{12}$, $T_{22}$) can be $$Z_{a.2} = \sqrt{Z_0 \cdot (n-2) \cdot Z_{ant}} \text{ and } Z_2 = Z_0 \cdot \sqrt{\frac{n-2}{n-1}},$$

respectively.

Impedances ($Z_{a,3}$~$Z_{a,n-1}$) of the 3rd to n-lth parallel impedance conversion means (($Ta_{13}$~$Ta_{1n-1}$), ($Ta_{23}$~$Ta_{2n-1}$)) and impedances ($Z_3$~$Z_{n-1}$) of the 3rd to n-lth series impedance conversion means (($T_{13}$~$T_{1n-1}$), ($T_{23}$~$T_{2n-1}$)) corresponding to the remaining 3rd to n-lth radiation elements ($a_{1n-1}$, $a_{2n-1}$) can be calculated in a similar way.

That is, impedances ($Z_{a,1}$~$Z_{a,n-1}$) of the 1st to n-lth parallel impedance conversion means (($Ta_{11}$~$Ta_{1n-1}$), ($Ta_{21}$~$Ta_{2n-1}$)) can be calculated according to Math Formula 1, and impedances ($Z_{11}$~$Z_{n-1}$) of the 3rd to n-lth series impedance conversion means (($T_{11}$~$T_{1n-1}$), ($T_{21}$~$T_{2n-1}$)) can be calculated according to Math Formula 2.

$$Z_{a.i} = \sqrt{Z_0 \cdot (n-i) \cdot Z_{ant.i}},\ i = 1 \sim n-1 \quad \text{[Math Formula 1]}$$

-continued $$Z_i = Z_0 \cdot \sqrt{\frac{n-i}{n-(i-1)}},\ i = 1 \sim n-1 \quad \text{[Math Formula 2]}$$

However, impedance ($Z_{a.n}$) of the nth parallel impedance conversion means ($Ta_{1n}$, $Ta_{2n}$) and the impedance ($Z_n$) of the n-th series impedance conversion means ($T_{1n}$, $T_2$n) corresponding to the n-th radiation elements ($a_{1n}$, $a_{2n}$) in the first and second radiation parts (A1, A2), respectively, can be calculated according to Math Formulas 3 and 4, since the power distribution is unnecessary.

$$Z_{a.i}=\sqrt{Z_0 \cdot Z_{ant}},\ i=1 \quad \text{[Math Formula 3]}$$

$$Z_i=Z_0, i=n \quad \text{[Math Formula 4]}$$

Here, since each of the plurality of impedance conversion means performs impedance matching through Quarter-wave Impedance Transform, it is possible to have a wider bandwidth than an array antenna of a general series-fed structure.

However, since the N radiation elements (($a_{11}$~$a_{1n}$), $a_0$, ($a_{21}$~$a_{2n}$)) of the first and second radiation parts (A1, A2) are connected through a plurality of impedance conversion means, it can be viewed, from a DC point of view, as a whole connected state. Accordingly, in order to separately apply two bias voltages for adjusting the phase to the first and second radiation parts (A1, A2), a DC braking element (not shown) may be further included. Here, the DC braking element may be implemented, for example, as a capacitor element positioned between each of the two couplers (CP1, CP2) and the first radiation part (A1) and the second radiation part (A2) such that it can block direct current components. Alternatively, the DC braking element may be disposed between the 2-way divider (DV) and the two couplers (CP1, CP2).

The plurality of impedance conversion means described above may be implemented as a transmission line.

Figure 6:
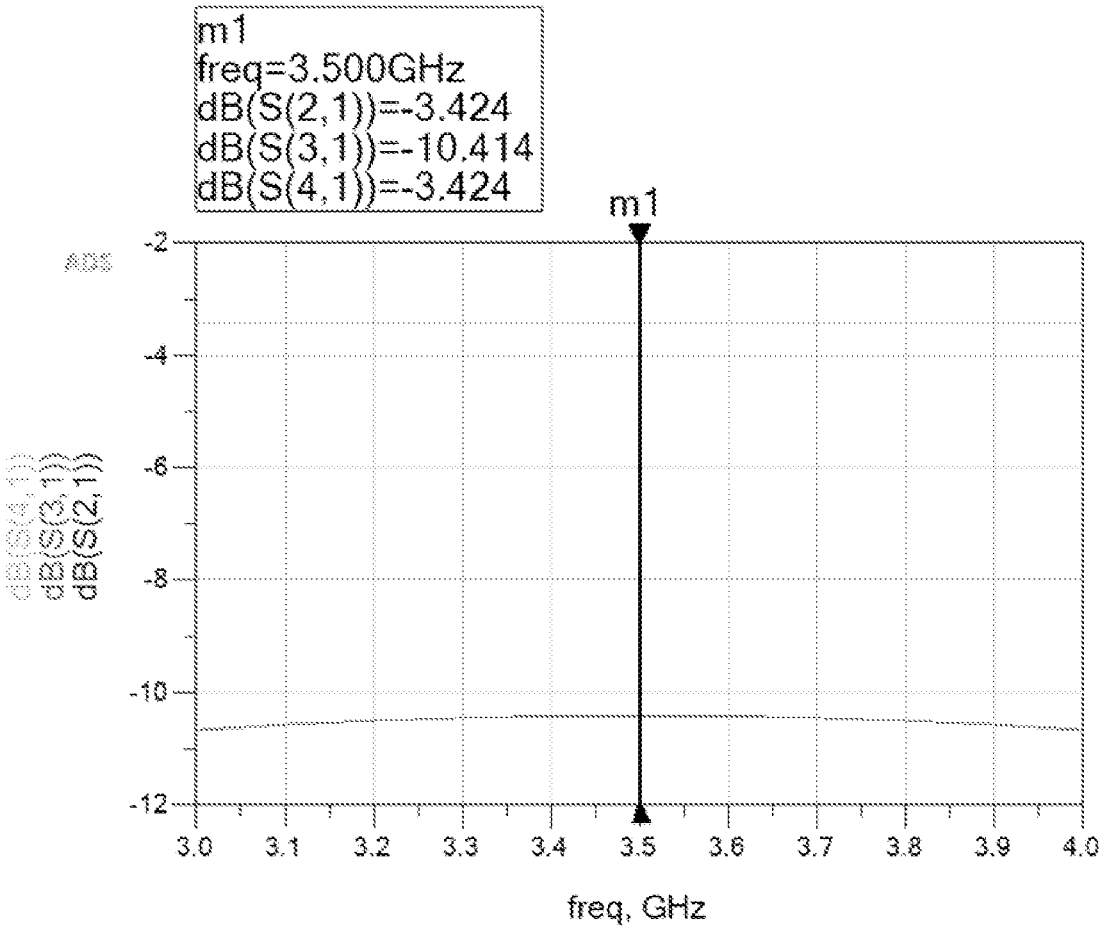
FIG. 6 shows a simulation result of the power distribution of the 3-way power divider of the center-fed array antenna according to the present embodiment.
Figure 7:
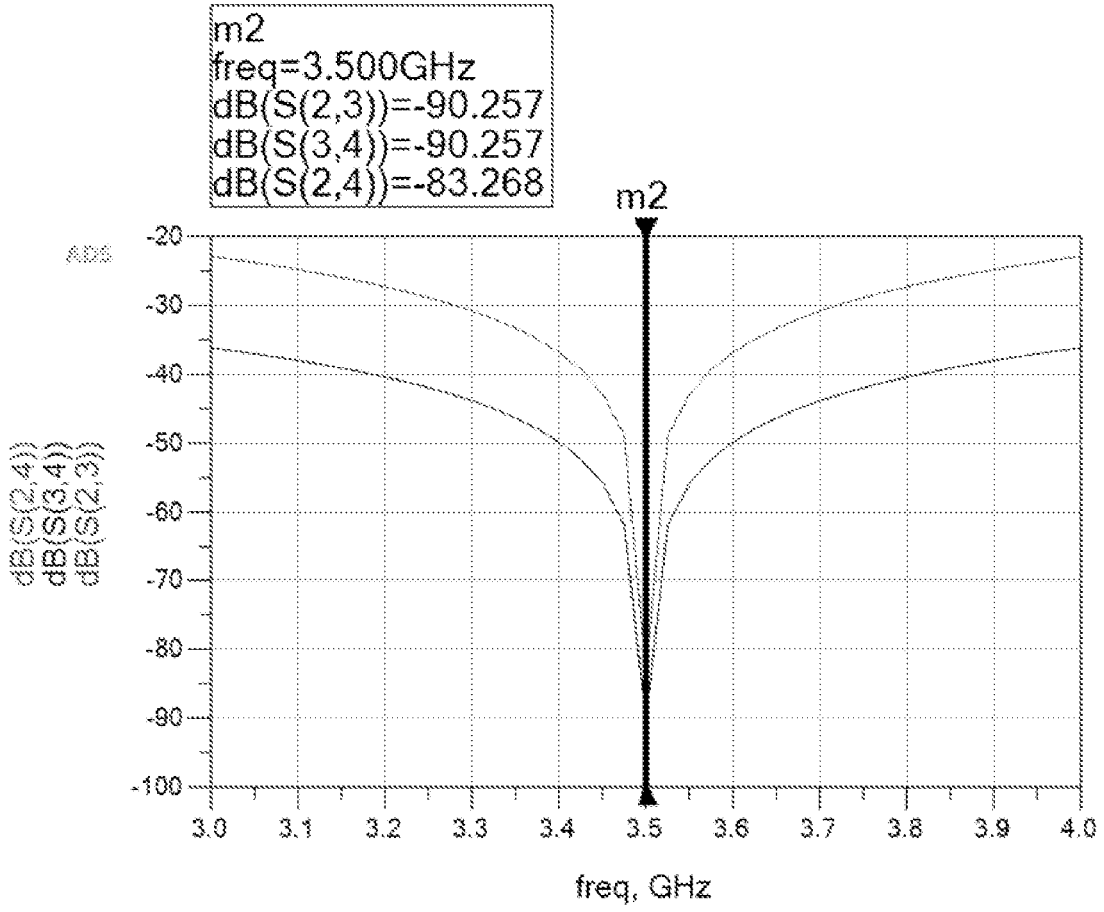
FIG. 7 shows a simulation result of the isolation degree of the 3-way power divider according to the present embodiment.

FIG. 6 shows a simulation result of the power distribution of the 3-way power divider of the center-fed array antenna according to the present embodiment, and FIG. 7 shows a simulation result of the isolation degree of the 3-way power divider according to the present embodiment.

In FIG. 6 and FIG. 7, a simulation result of the characteristic in the 3.5 GHz frequency band is shown, wherein the number (N) of the radiation element is 11 (N=11). As shown in FIG. 6, while the 3-way unequal power divider (udiv) according to the present embodiment shown in FIG. 4 uses a Wilkinson power divider, a Wilkinson combiner, and a 10.4 dB coupler, which is a 1/N (1/11) coupler, the first to third distribution feed signals output to the second to fourth ports (Port2~Port4) are 3.424 dB, 10.414 dB, and 3.424 dB, that is, they are distributed and transmitted with a power of an asymmetric ratio of 5:1:5.

In addition, as shown in FIG. 7, by using the Wilkinson power divider and Wilkinson combiner, the isolation between ports (Port2~Port4) can be secured in a wide range of −20 dB or less.

Figure 8:
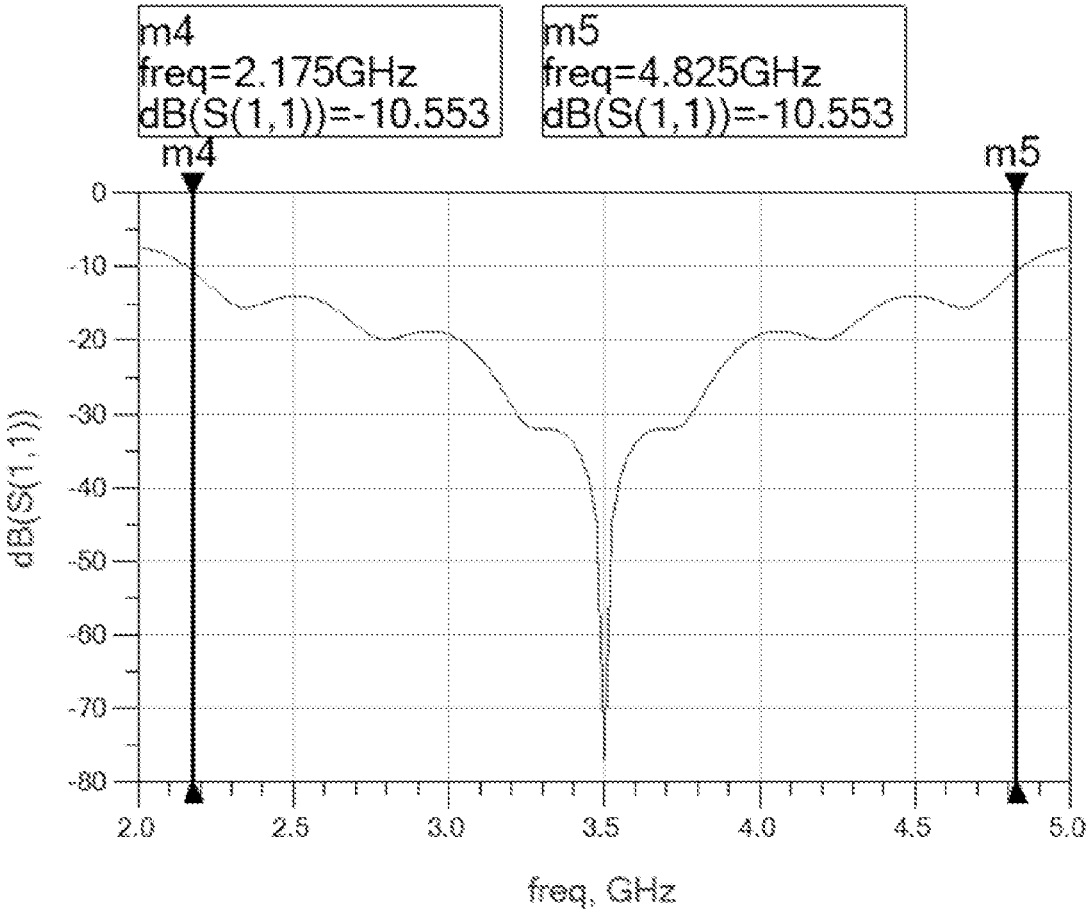
FIG. 8 shows a simulation result of the return loss of the center-fed array antenna according to the present embodiment.
Figure 9:
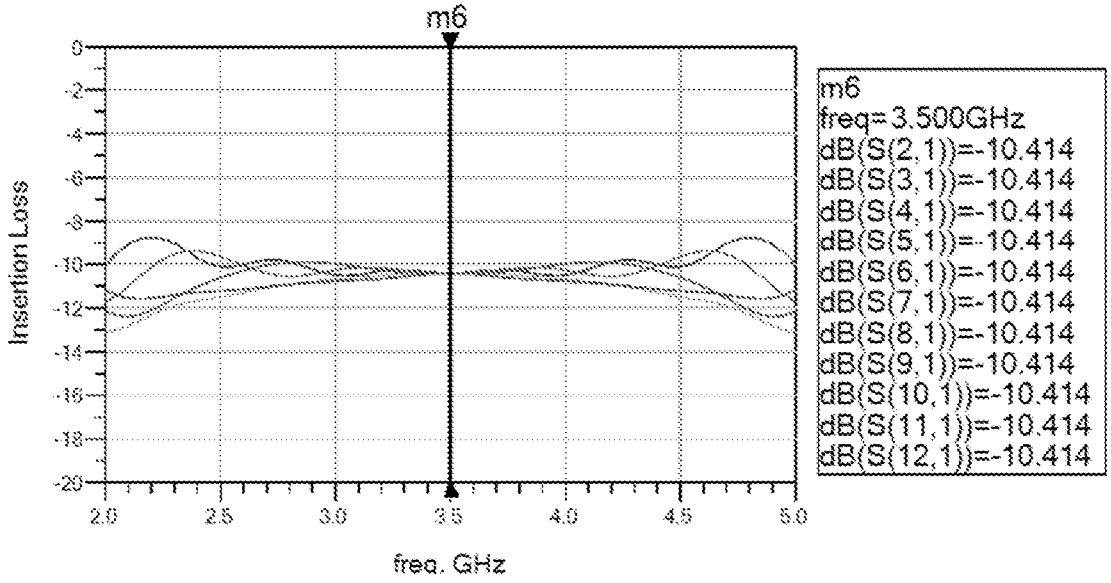
FIG. 9 shows a simulation result of the insertion loss of the center-fed array antenna according to the present embodiment.

FIG. 8 shows a simulation result of the return loss for an input terminal of the center-fed array antenna according to the present embodiment, and FIG. 9 shows a simulation result of the insertion loss for a plurality of radiation elements of the center-fed array antenna according to the present embodiment.

Also in FIG. 8 and FIG. 9, the number (N) of radiation elements is 11 (N=11), and a simulation result of the characteristic in the 3.5 GHz frequency band is shown. Referring to FIG. 8, it can be seen that the return loss of the 11 center-fed series array antenna circuit that is implemented by applying the above Math Formulas and 3-way power divider (udiv) has a wide bandwidth of 2.175 GHz~4.825 GHz at −10 dB.

Referring to FIG. 5, the impedance $$\left(Z_1 = Z_0 \cdot \sqrt{\frac{n-1}{n}}\right)$$

of the first series impedance conversion means ($T_{11}$, $T_{21}$) is an impedance for converting the reference impedance ($Z_0$) into $Z_0 \circ (n-1/n)$, and when applying such an impedance conversion means, as the number of radiation elements in the array antenna increases, the value of $Z_0 \circ (n-1/n)$ becomes similar to the reference impedance ($Z_0$). Therefore, since impedance matching can be performed by slightly changing the impedance, it can be made to have a wide bandwidth.

Meanwhile, referring to FIG. 9, the insertion loss for the 11 radiation elements is equally distributed at the center frequency, so it appears as −10.414 dB which is 1/11. That is, it can be seen that the feed signal is distributed and applied with equal power to the 11 radiation elements.

While one or more embodiments have been described with reference to the figures, it will be understood by those of ordinary skill in the art that various changes in form and details may be made therein without departing from the spirit and scope as defined by the following claims and their equivalents.

What is claimed is:

1. A center-fed array antenna, comprising:

a central radiation element located in the center among an odd number of N radiation elements;

a first radiator including a plurality of n first radiation elements, wherein n=(N−1)/2, positioned on one side with respect to the central radiation element and n first phase shifters corresponding to each of the n first radiation elements;

a second radiator including a plurality of n second radiation elements positioned on the other side with respect to the central radiation element and n second phase shifters corresponding to each of the n second radiation elements; and a 3-way power divider which receives a feed signal, distributes the feed signal in an asymmetric ratio in proportion to the ratio of the number of radiation elements included in the central radiation element and the first and second radiators, to obtain three first to third distribution feed signals, and outputs the first to third distribution feed signals to the corresponding central radiation element and the first and second radiators, respectively, wherein the n first phase shifters receive same first bias voltage and adjust the phase by a pre-designated same phase respectively, wherein the n second phase shifters receive same second bias voltage and adjust the phase by a pre-designated same phase respectively.

2. The center-fed array antenna according to claim 1, wherein the 3-way power divider includes:

a 2-way divider that receives the feed signal, equally divides power of the feed signal, and outputs two split feed signals;

first and second couplers each receiving a corresponding split feed signal among the two split feed signals, extracting a coupling signal by coupling the corresponding split feed signal, extracting the coupling signal at a power ratio of 1/N from the corresponding split feed signal, obtaining a remaining split feed signals that has a power ratio of (N−1)/N compared to the split feed signal by extracting the coupling signal from the split feed signal by the first and second couplers, as first and third distribution feed signals, and then outputting the first and third distribution feed signals to the corresponding radiator among the first and second radiators; and a combiner for receiving and combining the coupling signals extracted from each of the first and second couplers to obtain a second distribution feed signal and transmitting the second distribution feed signal to the central radiation element.

3. The center-fed array antenna according to claim 2, wherein the 2-way divider is implemented as a Wilkinson power divider.

4. The center-fed array antenna according to claim 2, wherein the combiner is implemented as a Wilkinson combiner.

5. The center-fed array antenna according to claim 2, wherein the n first phase shifters are connected in series from one end of the 3-way power divider through which the first distribution feed signal is output.

6. The center-fed array antenna according to claim 5, wherein, in the n first radiation elements, n−1 first radiation elements are connected in parallel between the n first phase shifters, and the n-th first radiation element is connected in series to the n-th first phase shifter among the n first phase shifters.

7. The center-fed array antenna according to claim 6, wherein the n second phase shifters are connected in series from the other end of the 3-way power divider through which the third distribution feed signal is output.

8. The center-fed array antenna according to claim 7, wherein, in the n second radiation elements, n−1 second radiation elements are connected in parallel between the n second phase shifters, and the n-th second radiation element is connected in series to the n-th second phase shifter among the n second phase shifters.

9. The center-fed array antenna according to claim 8, wherein, in the center-fed array antenna, a beam direction is adjusted according to the first and second bias voltages.

10. The center-fed array antenna according to claim 8, wherein the center-fed array antenna further includes a plurality of impedance converters for performing impedance matching by using the impedance of each of the n first phase shifters and the n second phase shifters as a reference impedance.

11. The center-fed array antenna according to claim 10, wherein the plurality of impedance converters include:

an input impedance converter connected to an input terminal to which the feed signal is applied in the 3-way power divider;

a central impedance converter connected between the 3-way power divider and the central radiation element;

n first series impedance converter having one end connected to the other end of each of the n first phase shifters connected in series;

n first parallel impedance converter connected between the other end of the n first series impedance converter and a corresponding radiation element among the n first radiation elements;

n second series impedance converter having one end connected to the other end of each of the n second phase shifters connected in series; and n second parallel impedance converter connected between the other end of the n second series impedance converter and a corresponding radiation element among the n second radiation elements.

12. The center-fed array antenna according to claim 11, wherein each of the input impedance converter and the central impedance converter has the reference impedance.

13. The center-fed array antenna according to claim 12, wherein, in each of the n first parallel impedance converter and the n second parallel impedance converter, n−1 parallel impedance converter adjacent to the 3-way power divider have an impedance calculated according to the following math formula:

$$Z_{a.i}=\sqrt{Z_0\cdot(n-1)\cdot Z_{\text{ant},i}},\ i=1\sim n-1$$

(wherein, $Z_{a,i}$ is the impedance of the ith parallel impedance converter, $Z_0$ is the reference impedance, and $Z_{ant,i}$ is the impedance of the ith radiating element of the first and second radiators), and the nth parallel impedance converter has an impedance calculated according to the following math formula:

$$Z_{a.i}=\sqrt{Z_0\cdot Z_{\text{ant}}},\ i=n.$$

14. The center-fed array antenna according to claim 13, wherein, in each of the n first series impedance converter and the n second series impedance converter, n−1 series impedance converter adjacent to the 3-way power divider have an impedance calculated according to the following math formula:

$$Z_i = Z_0\cdot\sqrt{\frac{n-i}{n-(i-1)}},\ i=1\sim n-1$$

(wherein $Z_i$ is the impedance of the ith series impedance converter), and the nth series impedance converter has the reference impedance ($Z_0$).

15. The center-fed array antenna according to claim 10, wherein the 3-way power divider further includes a DC braking element disposed between the first and second couplers and the first and second radiators, respectively, to filter a DC component.

16. The center-fed array antenna according to claim 10, wherein the 3-way power divider further includes a DC braking element disposed between the 2-way divider and the first and second couplers, respectively, to filter a DC component.

* * * * *